US006836263B2

(12) United States Patent
Naka et al.

(10) Patent No.: US 6,836,263 B2
(45) Date of Patent: Dec. 28, 2004

(54) DISPLAY APPARATUS AND METHOD FOR DISPLAYING GRADATION LEVELS

(75) Inventors: Kazutaka Naka, Tokyo (JP); Masanori Takeuchi, Kawasaki (JP)

(73) Assignees: Hitachi, Ltd., Tokyo (JP); Fujitsu Hitachi Plasma Display Co., Kawasaki (JP)

( * ) Notice: Subject to any disclaimer, the term of this patent is extended or adjusted under 35 U.S.C. 154(b) by 237 days.

(21) Appl. No.: 09/930,817

(22) Filed: Aug. 15, 2001

(65) Prior Publication Data

US 2002/0027566 A1 Mar. 7, 2002

(30) Foreign Application Priority Data

Sep. 5, 2000 (JP) ..... 2000-273545

(51) Int. Cl.[7] ..... G09G 3/28
(52) U.S. Cl. ..... 345/60
(58) Field of Search ..... 345/60, 63, 77, 345/89, 61; 315/169.1, 169.3, 169.2, 160

(56) References Cited

U.S. PATENT DOCUMENTS 5,187,578 A * 2/1993 Kohgami et al. ..... 348/687
6,127,991 A * 10/2000 Uehara et al. ..... 345/60
6,407,506 B1 * 6/2002 Naka et al. ..... 315/169.1

FOREIGN PATENT DOCUMENTS

JP 11-024628 1/1999

* cited by examiner

*Primary Examiner*—Chanh Nguyen
(74) *Attorney, Agent, or Firm*—Townsend and Townsend and Crew LLP

(57) ABSTRACT

A display and an image displaying method which ensure gradation expression by a sub field system limits display resolution information in predetermined sub fields, excluding a lower sub field, thereby shortening an address control period. Further, noise dots originated from error diffusion is made less noticeable dot by dot by independently controlling the least significant sub field. This limits the amount of resolution information of a displayed image and improves the general image quality.

20 Claims, 6 Drawing Sheets

DISPLAY APPARATUS AND METHOD FOR DISPLAYING GRADATION LEVELS

BACKGROUND OF THE INVENTION

1. Field of the Invention

The present invention relates to a display and an image displaying method, and, more particularly, to a display and an image displaying method, which carry out gradation expression by a sub field system and sequentially output and display data line by line in each sub field.

2. Description of the Related Art

Recently, flat and light panel displays which uses a liquid crystal or plasma and which have less screen distortion and are less susceptible to the influence of geomagnetism are becoming popular and are replacing conventional brown tube (CRT) displays. Particularly, attention is paid to the plasma display, which can be designed into a large panel relatively easily, as a display for video images.

In general, because the plasma display has a difficulty in displaying an intermediate gradation level between emission and non-emission, the intermediate gradation level is displayed using the so-called sub field system. The sub field system separates the time interval of one field into plural sub fields, assigns specific emission weights to the sub fields and controls the emission and non-emission of each sub field, thereby displaying gradation levels of the luminances of one field.

In the address-sustain separation system that is a leading system for plasma displays at present, one sub field consists of a reset period for initializing the states of discharge cells, an address control period for controlling ON/OFF of the discharge cells, and a sustain period for determining the amount of emission. Those periods are controlled by control pulses. The time intervals of those control pulses cannot be made shorter than a predetermined time period in order to realize stable emission control.

SUMMARY OF THE INVENTION

In the address control period, as addressing is carried out based on data that controls ON/OFF of the discharge cells line by line, a high-resolution panel requires a longer addressing time due to the large number of lines to be scanned. This raises such a problem that the number of sub fields providable in one field period is limited or sufficient luminance cannot be acquired. In case where a high-definition panel having a vertical resolution of 1000 lines is constructed using a display panel which requires 2 $\mu$s per line in the address control process, for example, the address control period of 2 ms (=2 $\mu$s×1000 lines) per sub field is needed. In general, displaying a video signal without degradation requires gradation of about 256 gradation levels (8 bits). If eight sub fields are to be provided in one field period of about 16.6 ms, there hardly is a time left to be assigned to the sustain period. Because one field period is mostly assigned to the address control period for each sub field, it is not possible to secure a sufficient sustain period that contributes to emission of the panel.

Japanese Patent Laid-Open No. 24628/1999 discloses the scheme that shortens the address control time by performing skip scanning for sub fields corresponding to lower bits and the system that performs a writing operation by simultaneously selecting two scan electrodes instead of using skip scanning. This document however discloses no specific signal generating schemes.

Each line of a video signal is data sampled in the vertical direction of one screen. At the time of thinning sampling data in skip scanning, the vertical resolution should be reduced to a half beforehand in order to decrease the cyclic interference. This lowers the vertical resolution by a half, providing a resolution-dropped image.

It is known that when sampling data is thinned without reducing the vertical resolution beforehand, a signal with a high-frequency component is converted to a DC signal or a signal of a lower frequency due to the cyclic interference, thus significantly degrading the image quality.

When the number of sub fields is limited to, for example, six sub fields for 64 gradation levels in order to achieve high luminance, the gradation cannot be displayed sufficiently, which makes it difficult to realize a high-image-quality display.

The conventional plasma displays that, unlike a CRT display, do not have the gamma characteristic have a tendency of making the display gradation on the low-luminance side rougher. It is said that if the gradation step in the vicinity of the black level is improved to the level of a CRT display, a gradation range from 10 bits (1024 gradation levels) to 12 bits (4096 gradation levels) is needed. Even with panels having a low vertical resolution (a smaller number of lines), therefore, the conventional displays employ a scheme of increasing the number of display gradation levels in a pseudo fashion before displaying by dithering, an error diffusion process or the like in order to make up the deficiency of the number of display gradation levels.

The systems, such as dithering and the error diffusion process, that display an image after increasing the number of display gradation levels in a pseudo fashion ensure pseudo display of an average luminance by enabling or disabling the minimum gradation steps. When the number of the minimum gradation steps is "1", for example, a gradation level of 0.5 is expressed in a pseudo fashion by alternately enabling and disabling the minimum gradation step and a finer intermediate gradation level can be expressed equivalently by changing the ratio of the enableness and disableness.

It is known that while the use of the pseudo intermediate gradation can display a greater number of gradation levels than the actual gradation levels in a pseudo fashion, the enabling/disabling pattern of the minimum gradation step becomes noticeable as dot noise.

In the gradation display based on the sub field system, the gradation of the minimum gradation step is equivalent to the amount of emission of the least significant sub field. As mentioned above, the conventional plasma displays that, unlike a CRT display, do not have the gamma characteristic have a tendency of making the display gradation on the low-luminance side rougher.

In case where the pseudo intermediate gradation is adapted, therefore, interference is likely to be noticeable which is originated from dot noise that is produced when the gradation between the black level and the gradation of the minimum gradation step at which the least significant sub field is enabled is expressed in a pseudo fashion.

In case where data of the least significant sub field is made identical between upper and lower lines in the system disclosed in Japanese Patent Laid-Open No. 24628/1999, the dot area of the dot noise becomes twice as large, significantly deteriorating the image quality.

Accordingly, it is an object of the invention to provide a display technique which can shorten the address control period in accordance with the required luminance and assign the produced extra time to an improvement of the image quality, such as the luminance, gradation and pseudo contour.

It is another object of the invention to provide a display technique which has a high luminance or an excellent gradation characteristic and can shorten the address control period while keeping the effect of suppressing the conventional pseudo contour interference.

The invention aims at providing a display and an image displaying method, which are provided with a signal processing circuit for processing sub field data by referring to signals of plural lines that are to be made common in a lower sub field in such a way that the degradation of the image quality occurs less and predetermined sub field data becomes identical, and which limit the amount of resolution information of a displayed image as needed by positively using the human visual characteristics or the statistical property of video images to thereby improve the general image quality.

The invention also aims at providing a display and an image displaying method which can set error-diffusion originated dot noise near the black level to the level provided by the prior art.

To achieve the objects, the invention uses the following means.

The invention uses a signal processing circuit which processes data of lower sub fields, excluding the least significant sub field, by referring to signals of plural lines, so that predetermined sub field data becomes identical.

Further, the interference originated from dot noise in pseudo intermediate gradation display is set to the same level as provided by the prior art by controlling the least significant sub field dot by dot.

Furthermore, an average value f0 of plural lines to be referred to is computed and an error diffusion process is executed based on the average value f0.

Specifically, the average value f0 is separated into a display effective bit (f0M) and a non-display lower bit (f0L) and the non-display lower bit is added to a residual error component (f0E') which could not be displayed with the available display pixels. When the added value reaches the amplitude that is equivalent to the display effective bit, the display effective bit is increased to update the undisplayable residual error component.

According to the invention, it is determined if an average luminance level which is displayable by a combination of minimum gradation steps of the reference lines is present in the residual error component (f0E), and, if such an average luminance level is present, the minimum gradation steps of the reference lines are changed to ensure intermediate gradation display. The residual error component is updated by this intermediate gradation display.

Only when the least significant bit (LSB) data of the display effective bit (f0') is "0", an intermediate gradation level is displayed by a combination of the least significant bit steps of the reference lines.

Moreover, the residual error component is diffused to the adjoining pixels on the display screen.

DETAILED DESCRIPTION OF THE PREFERRED EMBODIMENTS

Preferred embodiments of the invention will now be described with reference to the-accompanying drawings.

Figure 1:
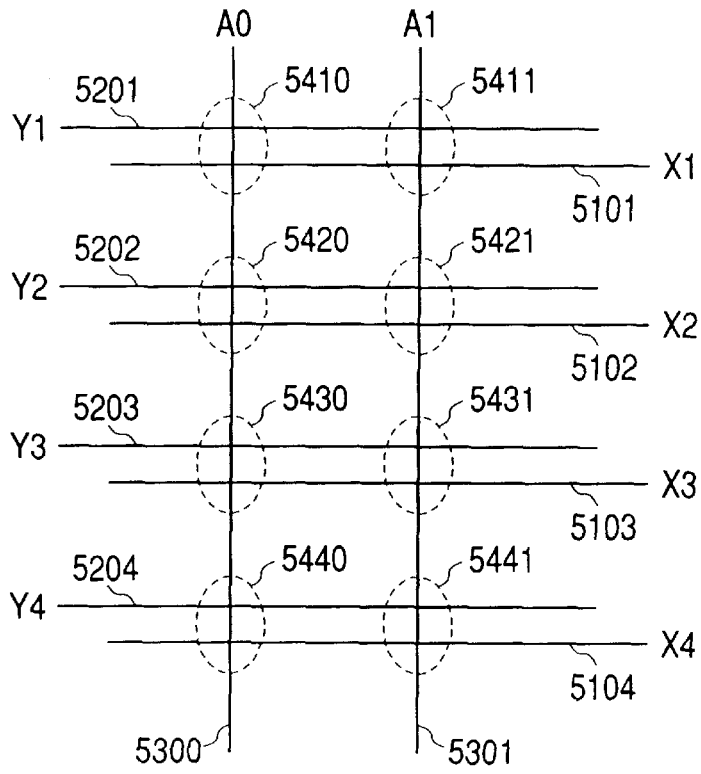
FIG. 1 is an exemplary diagram showing the layout of discharge cells and electrodes of an AC3 electrode type plasma display.

FIG. 1 is an exemplary diagram showing the layout of discharge cells and electrodes of an ordinary AC3 electrode type plasma display.

In the diagram, "5101", "5102", "5103" and "5104" denote X sustain electrodes, "5201", "5202", "5203" and "5204" denote Y sustain electrodes, and "5300" and "5301" denote address electrodes. The address electrodes 5300 and 5301 are formed on a back plate, and the X sustain electrodes 5101 to 5104 and the Y sustain electrodes 5201 to 5204 are formed on a front plate. Pixels are formed at the intersections of the address electrodes 5300 and 5301 and electrodes pairs of the X sustain electrodes 5101 to 5104 and the Y sustain electrodes 5201 to 5204. Discharging between those electrodes forms pixels 5410, 5411, 5420, 5421, 5430, 5431, 5440 and 5441 on the panel as shown in FIG. 1.

Figure 2:
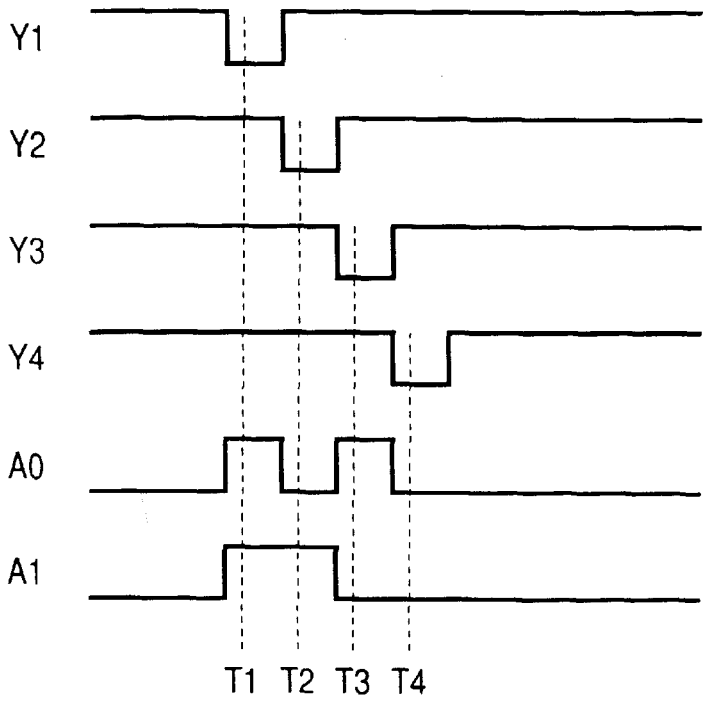
FIG. 2 Prior Art
FIG. 2 is a diagram showing voltages to be applied to Y sustain electrodes and address electrodes in an address control period according to the prior art.

FIG. 2 is a diagram showing the waveforms of voltages to be applied to the Y sustain electrodes and address electrodes in an address control period. As illustrated in the figure, a scan pulse is applied to the Y1 sustain electrode 5201, Y2 sustain electrode 5202, Y3 sustain electrode 5203 and Y4 sustain electrode 5204 in the named order, and an address pulse which controls ON/OFF is applied to the A0 address electrode 5300 and A1 address electrode 5301 line by line.

As the scan pulse is applied to the Y1 sustain electrode 5201 at time T1, the ON/OFF of the pixels 5410 and 5411 in the first line is controlled. In this example, as an address voltage is applied to both the A0 address electrode 5300 and A1 address electrode 5301, address discharge occurs between the A0 address electrode and the Y1 sustain electrode and between the A1 address electrode and the Y1 sustain electrode and barrier charges are formed in such a way as to ensure emission in the subsequent sustain period. Thereafter, addressing to control ON/OFF of the pixels 5420 and 5421 in the second line is performed at time T2, addressing to control ON/OFF of the pixels 5430 and 5431 in the third line is performed at time T3, and addressing to control ON/OFF of the pixels 5440 and 5441 in the fourth line is performed at time T4. This line-by-line addressing forms barrier charges in cells as needed and controls emission in the subsequent sustain period.

Figure 3:
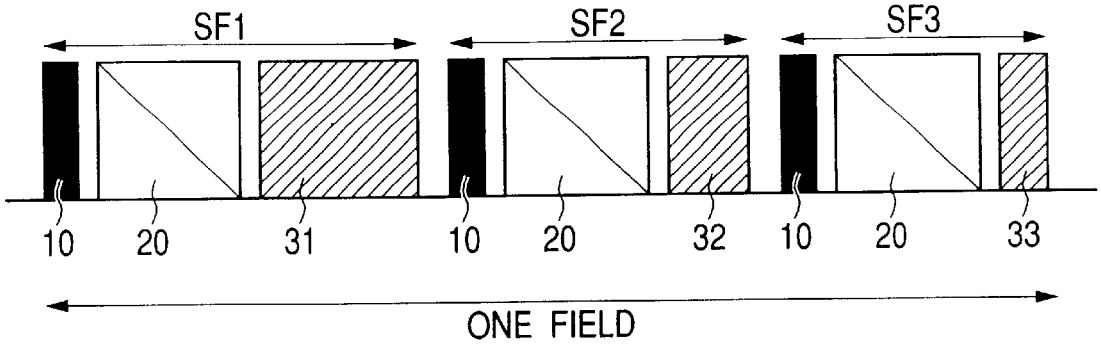
FIG. 3 Prior Art
FIG. 3 is a diagram depicting a field structure according to the prior art in which one field consists of three sub fields.

FIG. 3 is an exemplary diagram depicting a field structure according to the prior art in which one field consists of three sub fields (SF1, SF2 and SF3). In the diagram, "10" is a reset period for initializing the states of discharge cells in each sub field, "20" is an address control period for controlling ON/OFF of each pixel in each sub field, "31", "32" and "33" are sustain periods for determining the amount of emission in the respective sub fields. In the sustain periods 31 to 33, emission according to the number of sustain pulses is performed on discharge cells in which barrier charges are so formed as to ensure emission in the address control period 20. In the sub field system, emission weights are assigned to the respective sub fields SF1 to SF3 to realize gradation display. In this example, the numbers of sustain pulses in the sustain periods 31 to 33 of the sub fields SF1 to SF3 are designed in such a way as to provide a ratio of emission weights of approximately 4:2:1. This can permit the display of gradation levels from gradation 0 where none of the sub fields SF1 to SF3 emit light to gradation 7 (=4+2+1) where all the sub fields SF1 to SF3 emit light. The maximum luminance displayable (gradation 7) is determined by the total number of sustain pulses in the sustain periods 31 to 33. If the time which does not contribute to emission, such as the address control period 20 in one field, becomes longer, the luminance cannot be secured sufficiently so that a high image quality cannot be obtained. The address control period 20 requires the time that is proportional to the number of display lines, and a single address control period is needed for one sub field. To realize a high-resolution display panel, therefore, a sufficient number of fields cannot be secured, resulting in an insufficient number of display gradation levels, or the luminance becomes lower, thus degrading the image quality.

Figure 4:
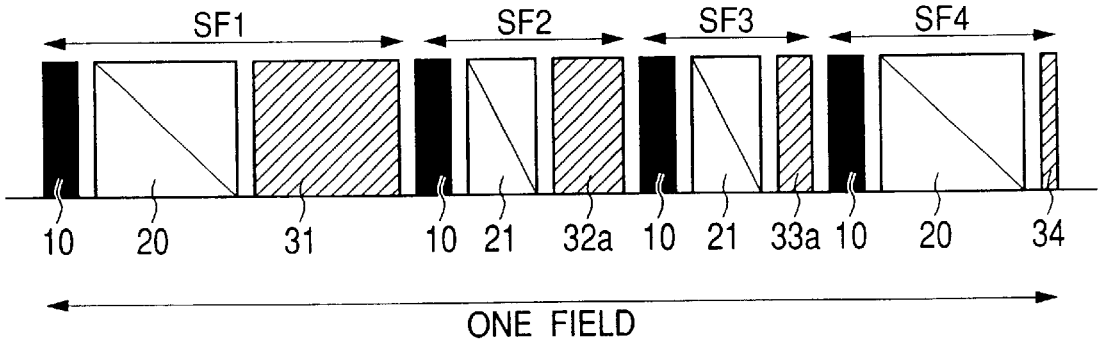
FIG. 4 is a diagram depicting a field structure according to a first embodiment of the invention in which the number of least significant sub fields is increased and address control periods for lower sub fields excluding the least significant sub fields are reduced to a half.

FIG. 4 is an exemplary diagram depicting a field structure according to one embodiment of the invention in which one field consists of plural sub fields. In the illustrated field structure, as compared with the conventional frame structure shown in FIG. 3, a sub field SF4 is added, and address control periods for lower sub fields SF2 and SF3 in the sub fields SF1 to SF4, excluding the least significant sub field SF4, are reduced to a half.

In the diagram, "21" is an address control period which is the address control period 20 in the sub field SF2 or SF3 in FIG. 3 reduced to a half, "34" is a sustain period for the added sub field SF4, and "32*a*" and "33*a*" are sustain periods for the sub fields SF2 and SF3. The emission weights of the sustain periods 32*a*, 33*a* and 34 are so designed as to become smaller in the named order. The structures of the other portions correspond to the structures of those portions in FIG. 3 that have the same symbols.

As illustrated in FIG. 4, addressing is performed on all the lines in the sub field SF1 and the sub field SF4 as done in the example shown in FIG. 3, and addressing is performed every two lines with the same data in the sub fields SF2 and SF3.

According to the embodiment, the address control period 21 for the sub fields SF2 and SF3 is a half the normal address control period 20, and the total address control period in one field period is nearly equal to that for the 3-sub-field structure of the prior art shown in FIG. 3, so that the number of display gradation levels can be increased while maintaining approximately the same luminance as the luminance of the prior art.

An extra time is produced in one field by controlling the least significant sub field SF4 for two lines with the same data, making it possible to improve-the luminance by increasing the number of sustain pulses or increase the number of display gradation levels by increasing the number of sub fields. In this case, however, lower sub fields are controlled for two lines with the same data, so that when pseudo intermediate gradation display acquired by dithering or the error diffusion process is also used, the size of dot noise becomes twice as large, significantly degrading the image quality. According to the embodiment, however, because the least significant sub field SF4 is controlled dot by dot, the interference by the dot noise can be suppressed to about the same level as that of the prior art.

Figure 5:
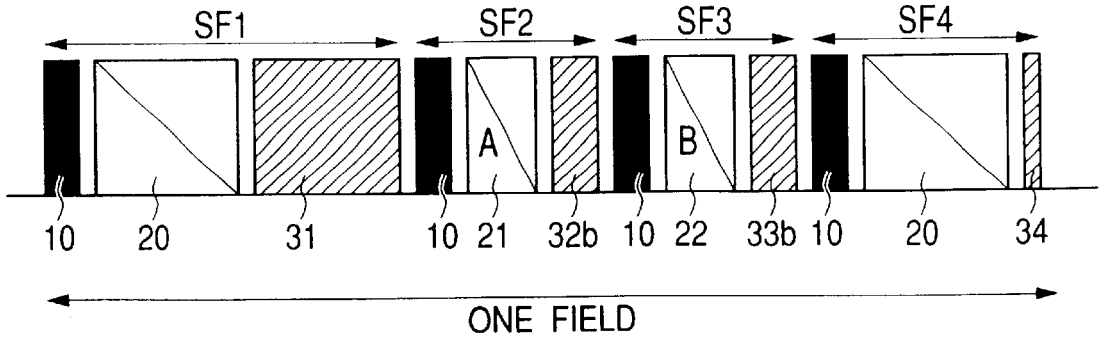
FIG. 5 is a diagram depicting a field structure according to a second embodiment of the invention in which the number of least significant sub fields is increased, address control periods for lower sub fields excluding the least significant sub fields are reduced to a half and emission ratios in sustain periods for the lower sub fields are made equal to one another.

FIG. 5 is an exemplary diagram depicting a field structure according to another embodiment of the invention in which one field consists of plural sub fields. In the illustrated field structure, as compared with the conventional frame structure shown in FIG. 3, a sub field SF4 is added, address control periods for lower sub fields SF2 and SF3 in the sub fields SF1 to SF4, excluding the least significant sub field SF4, are reduced to a half, and the emission ratios of the sustain periods 32*b* and 33*b* are set equal to each other.

In the diagram, "21" is an address control period which is shortened by performing intra-data thinning on the sub field SF2 at the first phase, "22" is an address control period which is shortened by performing intra-data thinning on the sub field SF3 at the second phase, "32*b*" and "33*b*" are sustain periods for the sub fields SF2 and SF3 having the same emission ratio, and "34" is a sustain period for the sub field SF4. The other structure is the same as that shown in FIG. 3.

In the embodiment, the emission ratios of the sub fields SF1 to SF4 are not designed to be 2's power, such as 1:2:4: . . . , but are designed in such a way that the amount of emission of the sub field SF2 is set equal to the amount of emission of the sub field SF3. Specifically, emission weights of, for example, 4:2:2:1 are given. While designing the emission ratios to be different from 2's power reduces the number of gradation levels displayable with the same number of sub fields, pseudo contour interference specific to the sub field system can be reduced.

In the embodiment, the address control periods 21 and 22 are shorted with respect to the two sub fields SF2 and SF3 that have the equal emission weight, and data is thinned at different phases between the sub fields SF2 and SF3.

In the system in which the same pair of two lines is always processed with the same data as in another embodiment, data for two lines are likely to become quasi values, which may cause interference called line pairing.

According to the embodiment, however, there are two line pairs that are processed with the same data, thus making line pairing less noticeable.

As the least significant sub field SF4 is controlled dot by dot, pseudo intermediate gradation display acquired by dithering or the error diffusion process is used too can be set about the same as that in the prior art.

According to the embodiment, as apparent from the above, the address control period can be shortened while maintaining the effect of reducing the conventional pseudo contour interference. The embodiment can therefore provide a display having high luminance or an excellent gradation characteristic. It is also possible to reduce the pseudo contour interference by increasing the number of sub fields by using the time that is produced by shortening the address control period.

To suppress such line pairing, the phases of lines to be thinned may be made different from each other even in the case of sub fields having different emission weights as in the first embodiment. Further, the phases of lines to be thinned may be changed field by field. For example, lines to make a pair may be changed between an odd field and an even field.

Figure 6:
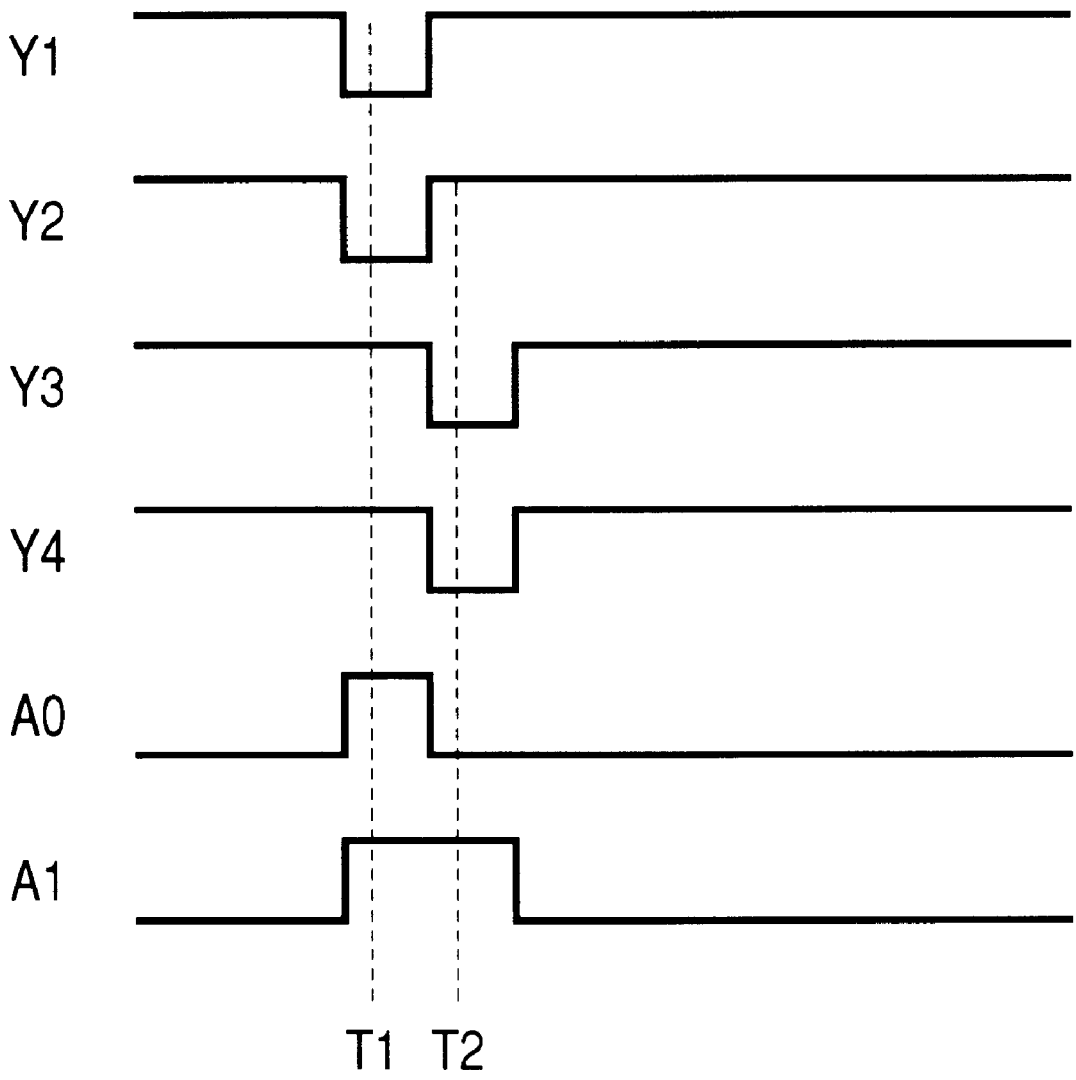
FIG. 6 is a diagram showing voltages to be applied to Y sustain electrodes and address electrodes in an address control period according to the first embodiment of the invention.

FIG. 6 is a voltage waveform diagram showing one example of voltages to be applied to the Y sustain electrodes and address electrodes in an address control period. Specifically, FIG. 6 shows voltages to be applied to the Y sustain electrodes 5201 to 5204 and the address electrodes 5300 and 5301 in an address control period.

As illustrated in the diagram, as the scan pulse is simultaneously applied to the Y1 sustain electrode 5201 and the Y2 sustain electrode 5202, two lines are simultaneously addressed with the same data. Following the addressing of the Y1 sustain electrode 5201 and the Y2 sustain electrode 5202, the Y3 sustain electrode 5203 and the Y4 sustain electrode 5204 are addressed at the same time. The execution of the addressing process by simultaneously applying the scan pulse to every two lines can shorten the time needed to scan the total lines of one screen by a half.

Although two lines are simultaneously addressed in the embodiment shown in FIG. 5, the number of lines to be addressed simultaneously is not limited to two. For example, three lines or four lines may be addressed simultaneously in which case the addressing time required can be shorted to ⅓ or ¼. The target for the process of shortening the addressing time is not limited to the lower sub fields SF2 and SF3 in the sub fields SF1 to SF4, excluding the least significant sub field SF4 in FIGS. 4 and 5, but may be the sub field SF2 or the sub field SF3 alone. The structure may be modified in such a manner that the addressing period for the sub field SF2 is reduced to a half by addressing two lines simultaneously and the addressing period for the sub field SF3 is reduced to ⅓ by addressing three lines simultaneously. Although vertical resolution information of a lower sub field which has a small emission weight is lost through this processing, flat portions of an image can be displayed smoothly without any problem and signals of edge portions can be reproduced by upper sub fields which have large emission weights. Therefore, degradation of the image quality hardly occurs, thus ensuring high-luminance image display.

In case where a pair of lines to be addressed simultaneously with the same data is changed field by field or sub field by sub field in the embodiment shown in FIG. 5, the scan pulse should be simultaneously applied to the Y1 sustain electrode 5201 and the Y2 sustain electrode 5202 and to the Y3 sustain electrode 5203 and the Y4 sustain electrode 5204 in one field or one sub field, and the scan pulse should be simultaneously applied to the Y2 sustain electrode 5202 and the Y3 sustain electrode 5203 and to the Y4 sustain electrode 5204 and Y5 sustain electrode (not shown) in the next field or the next sub field.

Figure 7:
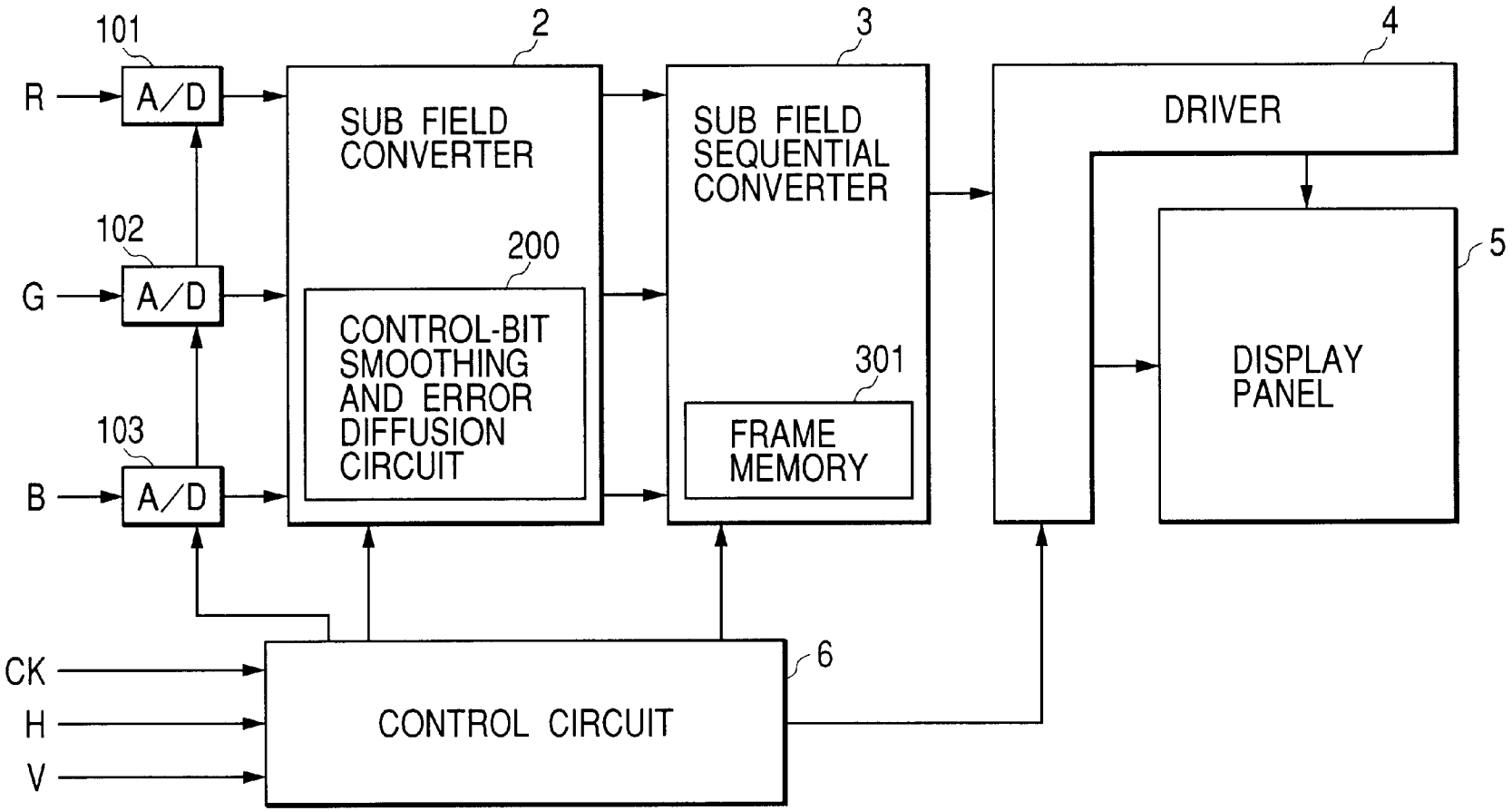
FIG. 7 is a block diagram showing the structure of a display to which the sub field structure according to each embodiment of the invention is adapted.

Referring now to FIG. 7, the structure of a display to which the sub field structure according to each of the embodiments shown in FIGS. 4 and 5 will be described.

FIG. 7 is a block diagram showing the structure of a display to according to one embodiment of the invention. In the diagram, the display comprises A/D converters 101, 102 and 103, a sub field converter 2 which incorporates a control-bit smoothing and error diffusion circuit 200, a sub field sequential converter 3 which has a frame memory 301, a driver 4, a display panel 5 and a control circuit 6. The A/D converters 101, 102 and 103 respectively convert R, G and B analog video signals to digital signals. The sub field converter 2 converts a binary digital to sub field data representing emission/non-emission of a sub field. The control-bit smoothing and error diffusion circuit 200 performs a smoothing process on a control bit corresponding to a sub field whose address control period is to be shortened, and an error diffusion process. The sub field sequential converter 3 converts sub field data, which is expressed pixel by pixel, to the form of sequential planes for each sub field. The frame memory 301 is used to accomplish a plane sequence bit by bit. The driver 4 additionally inserts a pulse needed for driving into a signal which has been converted to the sub-field-by-sub-field plane sequential form, thereby yielding a voltage (or a current) for driving the display elements. The display panel 5 provides gradation display based on the sub field system. The control circuit 6 generates control signals needed for each block from timing information of an input video signal, such as a dot clock CK, a horizontal sync signal H and a vertical sync signal V.

The R, G and B signals input are converted to digital signals by the A/D converters 101, 102 and 103. The digital signals are based on an ordinary binary notation and each bit has a weight of 2's power. Specifically, at the time of quantizing a digital signal consisting of eight bits, b0, b1, . . . , b6 and b7, the least significant bit b0 has a weight of 1, b1 has a weight of 2, b2 has a weight of 4, b3 has a weight of 8, and so forth, and b7 has a weight of 128. The sub field converter 2 converts those digital signals to sub field data indicating emission/non-emission of a sub field.

The sub field data consists of information on the number of bits corresponding to the number of sub fields that are to be displayed. In case of displaying an image with six sub fields, the sub field data consists of a 6-bit signal having S0, S1, . . . , and S5. The bit S0 indicates whether or not a target pixel emits light in the emission period of the top sub field SF1. Likewise, the bits S1, S2 and so forth indicate emission/non-emission of the sub fields SF2, SF3 and so forth. The control-bit smoothing and error diffusion circuit 200 performs a smoothing process on a control bit corresponding to a sub field whose address control period is to be shortened, and an error diffusion process. The smoothing process on the control bit is such data conversion that the control bit of sub field data on an upper line in two lines to make a pair and the control bit of sub field data on a lower line become the same data. The error diffusion process increases the number of apparent display gradation levels by ensuring pseudo-intermediate gradation by enabling or disabling the least significant gradation level. The detailed description of the sub-field control-bit smoothing process and the error diffusion process will be given later.

Next, the sub field data is input to the sub field sequential converter 3 and, is written pixel by pixel in the frame memory 301 provided in the converter 3. Data is read out from the frame memory 301 sub field by sub field in the plane sequential manner. Specifically, after one field of bit S0 indicating emission/non-emission of the sub field SF1 is read out, the bit S1 indicating emission/non-emission of the sub field SF2 is read out followed by reading of the bits S2, S3, . . . , and S5 in order, and those bits are output as address data, thereby constructing each sub field. At this time, in the sub field whose address control period is to be shortened, one line is thinned every two lines so that data for a half the lines is read out as address data. Then, the driver 4 performs signal conversion and pulse insertion that are needed to drive the display elements, and drives the matrix display panel 5.

The scan pulse that is output at the same time the address data in the address control period is output at the timing shown in FIG. 2 for a sub field which is addressed line by line in the normal mode but output at the timing shown in FIG. 6 for a sub field which is addressed two lines at a time to shorten the address control period. Alternatively, the scan pulse is output at the timing at which a pair of lines to which the same scan pulse in FIG. 6 is applied is shifted by one line.

The above-described structure can shorten the address control period of a predetermined sub field and can realize a display having a higher luminance or higher image quality as compared with the prior art.

Although the structure of the embodiment is designed to write all data in the frame memory 301 and thin one line every two lines at the time of shortening the address control period in the readout phase, lines may be thinned at the time of writing data. This structure can reduce the memory capacity required and can ensure higher resolution or greater number of gradation levels with a memory having the same capacity.

In case of performing a process of reducing the pseudo contour interference by increasing the number of sub fields or assigning different emission weights of 2's power, the sub field converter 2 converts the level of the input video signal to a sub field emission pattern. In case where an 8-bit input video signal is displayed in ten sub fields, for example, conversion of the 8-bit input to 10 bit sub field data is executed by a combination of logical circuits or a look-up table.

The structure of the control-bit smoothing and error diffusion circuit 200 will be discussed by referring to FIG. 8.

Figure 8:
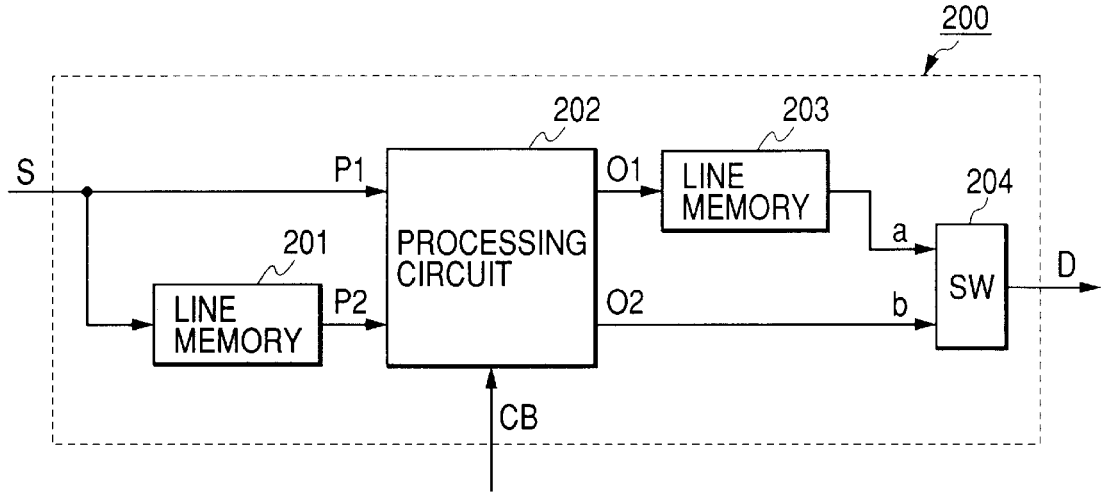
FIG. 8 is a block diagram illustrating the structure of a control-bit smoothing and error diffusion circuit shown in FIG. 7.

FIG. 8 is a block diagram illustrating the structure of the control-bit smoothing and error diffusion circuit 200 according to one embodiment of the invention. Referring to the diagram, the control-bit smoothing and error diffusion circuit 200 includes a line memory 201 which delays sub field data by one line, a processing circuit 202 which processes two inputs P1 and P2 in such a way that both bit data designated by a control signal CB become identical and provides outputs O1 and O2, a line memory 203 which delays the output O1 of the processing circuit 202 by one line, and a switch circuit 204 which switches two inputs a and b from one to the other line by line and outputs the selected input as an output D.

Sub field data S which has emission/non-emission of each sub field associated with bit data is input to the line memory 201 and the input P1 of the processing circuit 202. The sub field data that has been delayed by one line in the line memory 201 is input to the input P2 of the processing circuit 202. Based on the sub field data from the input P1 and the 1-line delayed sub field data from the input P2, the processing circuit 202 performs conversion on sub field data of two vertically adjoining pixels on the current line and sub field data of upper and lower adjoining two pixels on a previous line in such a way that predetermined bit data become identical. Further, the error diffusion process is performed so that the same gradation display can be provided in a pseudo fashion with fewer bits than the bits of the inputs P1 and P2.

The sub field data that has undergone such conversion is output from the processing circuit 202 as the outputs O1 and O2. Because the outputs O1 and O2 of the processing circuit 202 are sub field data of vertically adjoining pixels on the screen, the sub field data can be converted to sub field data D whose predetermined bit data takes the same value for two lines by delaying the output O1 by one line in the line memory 203 and switching the input to the switch circuit 204 line by line to make two lines of signals in a sequential form.

The positions of bits which are processed to have equal bit data in the processing circuit 202 are determined by the control signal CB, so that it is possible to set which sub field whose address control period should be shortened. Setting in case where the address control period is not shortened at all is also made by the control signal CB. In this case, the processing circuit 202 outputs the input P1 directly as the output O1 and outputs the input P2 directly as the output O2.

The control signal CB also sets the number of lower bits that are displayed in pseudo intermediate gradation levels by the error diffusion process. In case where a signal of 8 bits (=k+m) that provides 256 gradation levels is expressed by 6 bits (k) through the error diffusion process, for example, lower two bits (m=8−6) are the bits (non-display lower bits m) that are displayed in pseudo intermediate gradation levels.

The simplest structure for the control-bit smoothing process in the processing circuit 202 is to output predetermined bit data of the input P1 directly as bit data of the input P2 at the same bit position. This can allow both bit data to become identical. Alternatively, predetermined bit data of the input P2 may be output directly as bit data of the input P1 at the same bit position.

In case where data of lower bits vertically adjoining on the screen are made identical unconditionally, display data may change significantly, resulting in considerable degradation of the image quality. In this case, some kind of process to cope with the problem is required. When upper pixel data in adjoining two pixel data has level 16 and lower pixel data has level 15, for example, sub field expression based on emission weights of 2's power expresses level 16 as [1, 0, 0, 0] (in the order of upper SF to lower SF; "1" indicates emission SF and "0" indicates non-emission SF) and level 15 as [0, 1, 1, 1]. At this time, it is assumed that the sub fields equivalent to lower three bits are subjected to a process of thinning one line every two lines according to the skipping procedures. In this case, the lower three sub fields [1, 1, 1] in the lower pixel 15 [0, 1, 1, 1] are replaced with the lower three sub fields [0, 0, 0] in the upper pixel 16 [1, 0, 0, 0]. As a result, the levels to be displayed become [0, 0, 0, 0] and the level of the pixel that originally has level 15 becomes level 0.

If the lower three sub fields [0, 0, 0] in the upper pixel 16 [1, 0, 0, 0] are replaced with the lower three sub fields [1, 1, 1] in the lower pixel 15 [0, 1, 1, 1], on the other hand, the level of the upper pixel that originally has level 16 becomes level 31 [1, 1, 1, 1] whereas the level of the lower pixel remains to be level 15 [0, 1, 1, 1]. This increases the difference in level between those two pixels.

Figure 9:
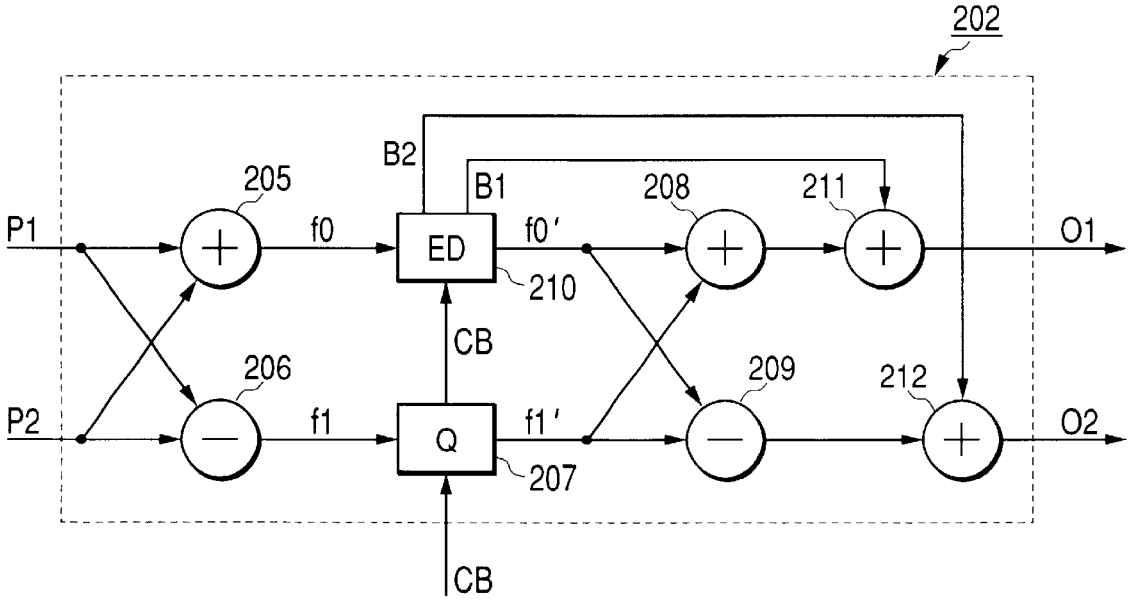
FIG. 9 is a block diagram exemplifying the structure of a processing circuit 202 shown in FIG. 8.

The following will discuss the specific example of the structure of the processing circuit 202 in FIG. 8 that is designed to overcome the problem and ensure dot-by-dot error diffusion and the operation of the processing circuit 202, with reference to FIG. 9.

FIG. 9 is a block diagram showing the processing circuit according to one embodiment of the invention. The processing circuit 202 includes adders 205 and 208, subtracters 206 and 209, a quantizing circuit 207 (abbreviated by "Q" in FIG. 9) whose characteristic is changed by the external control signal CB, an error diffusion processing circuit 210 (abbreviated by "ED" in FIG. 9), and adders 211 and 212.

The vertically adjoining pixels P1 and P2 that are input to the processing circuit 202 are input to the adder 205 and the subtracter 206. The adder 205 adds P1 and P2 and computes an average value f0 of the input signal to the error diffusion processing circuit 210 according to an equation 1 given below.

$$f0=(P1+P2)/2 \quad (1)$$

The subtracter 206 computes a value f1 based on the difference between P1 and P2 as given by the following equation 2.

$$f1=(P1-P2)/2 \quad (2)$$

The value f1 computed by the subtracter 206 is input to the quantizing circuit 207 and converted to f1'. The quantizing circuit 207 performs such a process that the lower n bits designated by the control signal CB become "0".

The average value f0 (bit width of k+m) computed by the adder 205 is input to the error diffusion processing circuit 210 and is output as a signal f0' (bit width of k) whose display effective bits are shortened by m bits ($m \leqq n$) through the error diffusion process. That is, the gradation equivalent to the lower m bits is displayed in a pseudo fashion and the lower m bits are equivalent to 0 data.

The error diffusion processing circuit 210 operates in such a way that even if the lower m bits are deleted from the average value f0 of the pixel data P1 and P2, leaving k bits, pseudo gradation display is possible. In the normal error diffusion process, pixel data, not an average value of two pixels, is processed directly, whereas in the embodiment, the average value f0 of two pixels is processed. Although the error diffusion process performed on the average value of adjoining two pixels in the embodiment differs from the normal pixel-by-pixel error diffusion process, the error diffusion process of the embodiment has an effect of suppressing a step-like or contour-like interference at an area where the luminance smoothly changes due to insufficient gradation, because an area where the luminance changes gradually is generally an area whose image quality is deteriorated due to insufficient gradation.

Although the detailed description of the operation of the error diffusion processing circuit 210 will be given later, a slight gradation level expressible by either the output O1 or O2 is detected and a 1-bit correction signal B1 or B2 is output from the error diffusion processing circuit 210. Each of the correction signals B1 and B2 is a level signal of the LSB (Least Significant Bit) of the signal whose bits are reduced to k bits by error diffusion and is output when the effective LSB of f0' is 0 in which case slight correction is required.

The signal f1' whose desired lower bits n are converted to "0" by the control signal CB is added to the signal f0' that has undergone the error diffusion process by the adder 208, and the correction signal B1 is further added to the output of the adder 208 by the adder 211 to thereby compute a converted output O1 according to the following equation 3.

$$O1=f0'+f1'+B1 \quad (3)$$

f1' is subtracted from f0' by the subtracter 209 and the correction signal B2 is then added to the output of the subtracter 209 by the adder 212, thereby yielding a converted output O2 expressed by the following equation 4.

$$O2=f0'-f1'+B2 \quad (4)$$

In case where slight correction with B1 and B2 is neglected, the lower n bits of f1' are "0", so that the lower n bits of O1 or O2 acquired by adding or subtracting f1' to or from f0' are output with the lower n bits of f0 unchanged. At this time, as the number of effective bits is reduced by m bits through the error diffusion process, data of the lower [m−n] bits of O1 and O2 can be made identical. Strictly, with no carry or borrow from a lower bit, addition and subtraction provide the equal computation results (operation with 2 as a divisor), data of the lower [m−n+1] bits of O1 and O2 can be converted identically. The value of the average (O1+O2)/2 of the outputs O1 and O2 at this time is always approximately equal to the average value f0 of the inputs P1 and P2, so that the average signal level of adjoining two lines can always be kept the same.

Because each of the correction signals B1 and B2 is the signal of the LSB whose bits are reduced by m bits by error diffusion and is output when the effective LSB of f0' is "0" and slight correction is needed as mentioned above, the effective LSB of either O1 or O2 changes to "1" from "0" when correction data is produced in either B1 or B2.

As the effective LSB of f0' before addition of B1 or B2 is "0", the effective LSB of O1 or O2 is "0" it is only the effective LSB that is changed (no carry occurred) by the addition of B1 or B2.

Although the above-described process makes the effective LSBs of O1 and O2 data independent of each other by B1 and B2, the lower [m−n+1] bits excluding the effective LSB can be made equal to each other with O1 and O2.

In the vicinity of the black level, f0'=0 and a dot-by-dot error diffusion process with B1 and B2 is carried out, thus making it possible to suppress noticeable dot noise near the black level to the dot-by-dot level of the prior art and to increase the luminance or the number of display gradation levels due to the shortened address control period. The increase in the number of display gradation levels further reduces the emission weights of the least significant sub field to about a half, making dot noise less noticeable.

Although the computation to reduce the number of bits to a half, which can be accomplished by cutting lower bits, is not illustrated specifically, it can be accomplished by arranging the outputs of the adder 205 and the subtracter 206 as indicated by the equations 1 and 2. To reduce a rounding error in the computation, the outputs of the adder 208 and the subtracter 209 may be designed to provide a ½ output. The quantizing characteristic of the quantizing circuit 207 is controlled by the control signal CB so that which lower bits should be set common can be controlled by the external setting of the control signal CB.

The average signal level f0 of two lines can be considered as a low frequency component in the vertical direction of an image, and the value f1 based on the difference between the two lines can be considered as a high frequency component in the vertical direction. Through the operation of the quantizing circuit 207, the vertical high frequency component f1 of a sub field equivalent to lower bits becomes "0" so that this sub field is constructed only the low frequency component f0. As a result, the vertical resolution of the sub field is limited to only the low frequency component f0 and the number of pieces of data in the address control period can be thinned (simultaneous addressing with the same data) before display.

As apparent from the above, the feature of the embodiment lies in that the resolution information of a specific sub field equivalent to desired bits can be limited to thereby shorten the address control period by separating the sub field into a plurality of vertical frequency components, selecting bits to be added or subtracted by the quantizing means and recombining the bits.

In case where the number of display bits is reduced through error diffusion with the use of the scheme of shortening the address control period, dot noise near the black level which is noticeable can be suppressed to the level of the prior art by independently controlling the sub field equivalent to the effective LSB dot by dot. Further, shortening the address control period can held realize a high-luminance and high-gradation display.

The specific example of the structure of the error diffusion processing circuit 210 shown in FIG. 9 will now be discussed referring to FIG. 10.

Figure 10:
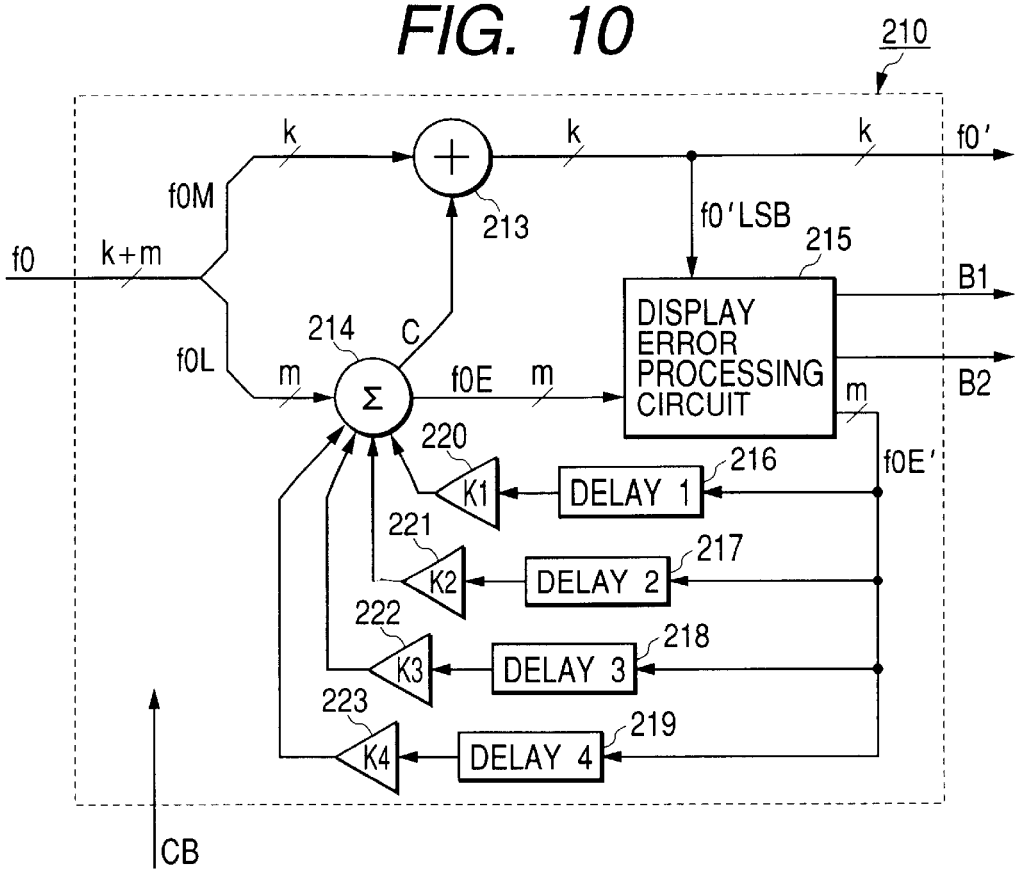
FIG. 10 is a block diagram exemplifying the structure of an error diffusion processing circuit 210 shown in FIG. 9.

FIG. 10 is a block diagram showing an error diffusion processing circuit according to one embodiment of the invention. Referring to the diagram, the error diffusion processing circuit 210 includes adders 213, 214, a display error processing circuit 215, delay circuits 216 to 219, and coefficient circuits 220 to 223 which respectively have coefficients K1, K2, K3 and K4.

The average value f0 (bit width of k+m) of the signals of adjoining two pixels is separated into a display effective bit f0M (bit width of k) and a non-display lower bit f0L (bit width of m). The display effective bit f0M is input to the adder 213 to be added to a carry signal from the adder 214 and the resultant data is output as the average value f0' whose bit width has been reduced to k bits. The non-display lower bit f0L (bit width of m) is input to the adder 214 to be added to the outputs of the coefficient circuits 220 to 223, and the m-bit addition result is input as residual error f0E to the display error processing circuit 215. A carry signal exceeding m bits from the adder 214 is sent to the adder 213 to be added to the display effective bit f0M, and the result is output as the average value f0' whose bits are reduced to k bits. The display error processing circuit 215 produces the slight correction signals B1 and B2 from the residual error f0E input from the adder 214 and f0'LSB, the LSB of the average value f0' whose bits are reduced to k bits, and outputs the slight correction signals B1 and B2 and also a residual error f0E' (bit width of m) updated with the slight correction signals B1 and B2. The updated residual error f0E' is input to the delay circuits 216 to 219. The output of the delay circuit 216 is multiplied by the coefficient K1 in the coefficient circuit 220 and the result is input to the adder 214. The output of the delay circuit 217 is multiplied by the coefficient K2 in the coefficient circuit 221 and the result is input to the adder 214. Likewise, the output of the delay circuit 218 is multiplied by the coefficient K3 in the coefficient circuit 222 and the result is input to the adder 214. Further, the output of the delay circuit 219 is multiplied by the coefficient K4 in the coefficient circuit 223 and the result is input to the adder 214.

The delay circuits 216 to 219 serve to diffuse the residual error components that could not be displayed to the adjoining pixels. For example, the delay circuit 216 is so set as to have a delay time equivalent to one pixel, the delay circuit 217 is so set as to have a delay time equivalent to a period shorter than one horizontal scan period by one pixel, the delay circuit 218 is so set as to have a delay time equivalent to one horizontal scan period, and the delay circuit 219 is so set as to have a delay time equivalent to a period longer than one horizontal scan period by one pixel. That is, the coefficient K1 is a diffusion coefficient of the residual error to the adjoining pixel to the right, the coefficient K2 is a diffusion coefficient of the residual error to the lower left pixel, the coefficient K3 is a diffusion coefficient of the residual error to the directly under pixel, and the coefficient K4 is a diffusion coefficient of the residual error to the lower right pixel, and K1+K2+K3+K4 is set to 1.0 or greater. As a specific example of setting, K1=7/16, K2=3/16, K3=5/16 and K4=1/16.

The adder 214, the display error processing circuit 215, the delay circuits 216 to 219 and the coefficient circuits 220 to 223 constitute a loop designed to accumulatively adds the non-display lower bit f0L that cannot be directly displayed by the display and the residual errors in the other peripheral pixels that could not be displayed. When the residual error reaches the size of the display effective bit during this accumulation, the residual error is output as a carry from the adder 214 and the level of the display effective bit f0M is increased by "1".

Even when the residual error does not reach the size of the display effective bit, if gradation display is made possible by the slight correction signals B1 and B2, a signal is sent to B1 or B2 to correct the residual error of the level equivalent to that signal. The slight correction signals B1 and B2 set the LSB of one of a pair of two lines to "1", to thereby ensure an equivalent expression of level 0.5. To prevent the condition of using same data from being unsatisfied due to a carry produced on a predetermined bit which has the same data on the two lines in order to shorten the address control period, one of B1 and B2 is set to "1" to thereby ensure an equivalent expression of level 0.5 when f0'LSB is "0" and the residual error becomes 0.5 or greater.

Note that the number of display effective bits (k) and whether the error diffusion process is enabled or disabled are controlled by the control signal CB.

With the above-described structure, by controlling the LSB that is independently controllable with the slight correction signals B1 and B2, dot-by-dot error diffusion can be achieved without preventing the condition of using same data from being unsatisfied even with respect to the signal processed to be the identical data in order to shorten the address control period.

This is the scheme of accomplishing the error diffusion process when the address control period in a sub field corresponding to a predetermined bit is reduced to a half by referring to two lines of data. The scheme is not limited to two lines, but may be adapted to a case where the address control period in a sub field corresponding to a predetermined bit is reduced to 1/3 or 1/4 by referring to three lines of data or four lines of data. In this case, the LSB of that of the residual error components (f0E) whose level (1/3 or 1/4) is expressible by a combination of the minimum steps of three lines or four lines and whose f0'LSB is "0" is corrected to ensure correction of slight gradation.

The specific example of the structure of the display error processing circuit 215 shown in FIG. 10 will now be discussed referring to FIG. 11.

Figure 11:
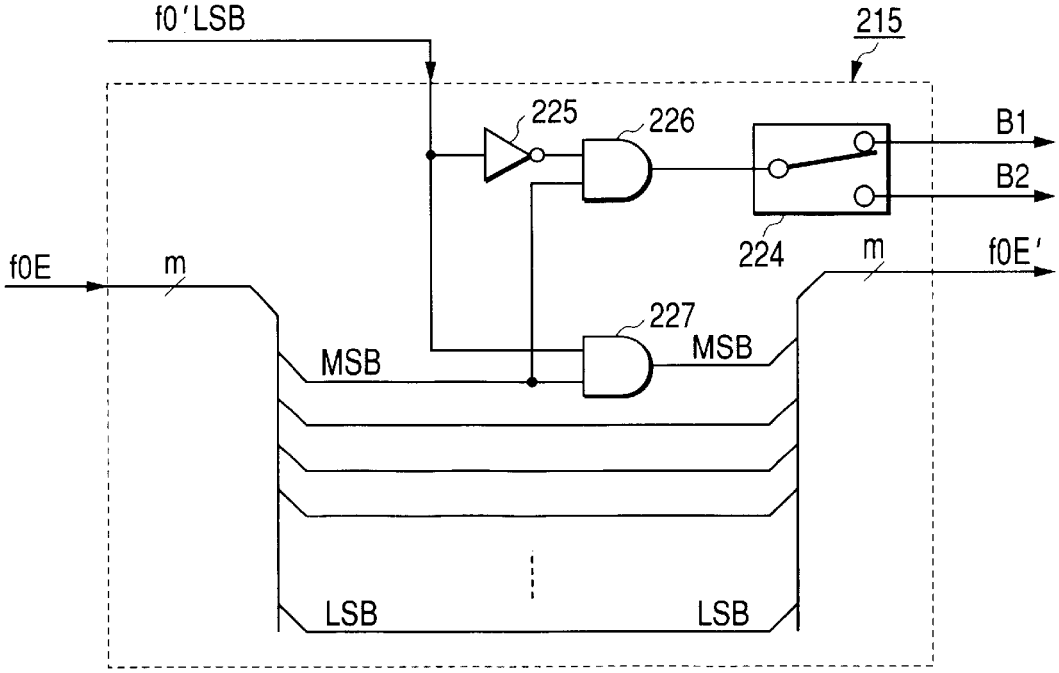
FIG. 11 is a block diagram exemplifying the structure of a display error processing circuit 215 shown in FIG. 10.

FIG. 11 is a block diagram showing a display error processing circuit according to one embodiment of the invention. Referring to the diagram, the display error processing circuit 215 includes a switch circuit 224, a logic inverter 225 and AND gates 226 and 227. The most significant bit (MSB) of the residual error f0E of m bits is input to the AND gate 227 and the AND gate 226. f0'LSB is input to the other input of the AND gate 227 and a signal obtained by logic inversion of f0'LSB is input to the AND gate 226. When f0'LSB is "1", therefore, f0E is output directly as f0E' and B1 and B2 become "0". When f0'LSB is "0", the MSB of f0E' becomes "0" and MSB data of f0E' is output to B1 or B2 via the AND gate 226 and the switch circuit 224. Accordingly, when f0'LSB is "0" and the residual error f0E is equal to or greater than 0.5 (MSB="1"), "1" is output from one of B1 and B2 so that one of a pair of two lines becomes "1", and the other becomes "0", thus expressing level 0.5. At this time, the MSB of f0E' becomes "0" and the residual error is updated in association with the displayed level 0.5.

Whether to select B1 or B2 has only to be determined specifically in accordance with the position of a target pixel; for example, B1 is selected for an even pixel and B2 is selected for an odd pixel. Alternatively, the selection may be inverted between an odd field and an even field. Such a structure can randomize dot noise in the vicinity of the black level, making the dot noise less noticeable.

B1 may be selected when f1>f1' at the time of changing f1 to f1' in the quantizing circuit 207 shown in FIG. 9, whereas B2 may be selected when f1<f1'. This ensure correction to provide a signal closest to the original signal and can provide a high-quality display.

The above-described structure can ensure dot-by-dot error diffusion while keeping bit data corresponding to a desired sub field at an equal value between adjoining lines.

Strictly, when only the LSB sub field (weight of 1) is independently controlled dot by dot and two lines of a sub field having the next smallest weight of 2 are displayed at the same address, the intermediate gradation level between gradation levels 0 and 1 becomes a dot-by-dot error diffusion pattern and the intermediate gradation level between gradation levels 1 and 2 becomes error diffusion pattern in the units of two dots because of f0'LSB being "1". But, the dot noise near the black level that is likely to be most noticeable appears dot by dot so that the substantial image quality can be made equivalent to the image quality acquired by the conventional error diffusion system. It is therefore possible to a display with a high image quality which is generally excellent in characteristics, such as the improved luminance and the increased number of display gradation levels.

The invention can shorten the address control period in accordance with the required luminance and allocate the produced extra time to the improvement of the image quality, such as the luminance, gradation level and pseudo contour.

The structure that thins the number of pieces of data of lower sub fields, excluding the sub field which has the smallest emission weight, and displays the resultant data can ensure the pseudo intermediate gradation display of the same level as that of the prior art through the error diffusion process.

Further, as the input video signal is separated into vertical frequency components and display resolution information is limited to thereby shorten the time for controlling a pixel to be enabled, it is possible to display an image of a high quality whose degradation is less noticeable.

In short, the invention can shorten the address control period and allocate the produced extra time to the improvement of the image quality, such as the luminance, gradation level and pseudo contour.

What is claimed is:

1. A display apparatus for displaying an image by turning on pixels of a display section, comprising:

an intermediate gradation processing circuit for ensuring pseudo-expression of an intermediate gradation by controlling a minimum gradation level of said display section; and a resolution limiting circuit for limiting display resolution information of a selected gradation level excluding said minimum gradation level, thereby shortening a time of selecting a pixel of said gradation level to be turned on, wherein said intermediate gradation processing circuit and said resolution limiting circuit convert data of a low order sub field, exclusive of a least significant sub field, in a manner to produce a specific sub field having identical data by processing a signal of plural lines and both of said circuits include a control-bit smoothing and error diffusion circuit which control said least significant sub field in dot-by-dot and forbid a carry to spread to a high order sub field,.

whereby said pixels of said display section are driven based on outputs of said intermediate gradation processing circuit and said resolution limiting circuit.

2. A display apparatus for displaying an image by turning on pixels of a display section, comprising:

an intermediate gradation processing circuit for ensuring pseudo-expression of an intermediate gradation by controlling a minimum gradation level of said display section;

a resolution limiting circuit for limiting display resolution information of a selected gradation level excluding said minimum gradation level, thereby shortening a time of selecting a pixel of said gradation level to be turned on;

a control circuit for controlling said intermediate gradation processing circuit and said resolution limiting circuit to control display resolution information of an image to be displayed on said display section; and a drive circuit for driving said display section based on outputs of said intermediate gradation processing circuit, said resolution limiting circuit and said control circuit, wherein said intermediate gradation processing circuit and said resolution limiting circuit convert data of a low order sub field, exclusive of a least significant sub field, in a manner to produce a specific sub field having identical data by processing a signal of plural lines and both of said circuits include a control-bit smoothing and error diffusion circuit which control said least significant sub field in dot-by-dot and prevent a carry bit to spread to a high order sub field.

3. The display apparatus according to claim 2, wherein said control circuit controls said intermediate gradation processing circuit and said resolution limiting circuit in such a way that a plurality of frequency components separated from said display resolution information are selectively combined.

4. The display apparatus according to claim 1 or 2, wherein said intermediate gradation processing circuit separates an input signal to said intermediate gradation processing circuit to a display effective gradation and a non-display low gradation, accumulates said non-display low gradation, and updating said non-display low gradation by increasing said display effective gradation when said accumulated non-display low gradation reaches said display effective gradation.

5. A display apparatus of a sub field type for displaying an image by turning on addressed pixels of a display section, comprising:

an intermediate gradation processing circuit for ensuring pseudo-expression of an intermediate gradation by controlling a least significant sub field of said display section;

an image signal processing circuit having a display resolution limiting circuit for limiting display resolution information of at least one lower sub field excluding said least significant sub field having a minimum emission weight, thereby shortening an address control period over which a pixel of said gradation level to be turned on is selected;

a control circuit for controlling said image signal processing circuit to control display resolution information of an image to be displayed on said display section; and a drive circuit for addressing and turning on said pixels of said display section based on outputs of said image signal processing circuit and said control circuit, wherein said intermediate gradation processing circuit and said resolution limiting circuit convert data of a low order sub field, exclusive of a least significant sub field, in a manner to produce a specific sub field having identical data by processing a signal of plural lines and both of said circuits include a control-bit smoothing and error diffusion circuit which control said least significant sub field in dot-by-dot and forbid a carry to spread to a high order sub field.

6. The display apparatus according to claim 5, wherein said control circuit controls said image signal processing circuit and said resolution limiting circuit in such a way that a plurality of frequency components separated from said display resolution information are selectively combined.

7. The display apparatus according to claim 5, wherein said intermediate gradation processing circuit separates an input signal to said intermediate gradation processing circuit to a display effective gradation and a non-display low gradation, accumulates said non-display low gradation, and updating said non-display low gradation by increasing said display effective gradation when said accumulated non-display low gradation reaches said display effective gradation.

8. A display of a sub field type for displaying an image by turning on addressed pixels of a display section, comprising:

said display section having said pixels arranged in a plurality of lines;

an intermediate gradation processing circuit for ensuring pseudo-expression of an intermediate gradation by controlling a least significant sub field;

a smoothing circuit for aligning bit data of sub field data of predetermined sub fields of a plurality of lines of said display section, excluding said least significant sub field, thereby limiting an address control period in said predetermined sub fields;

an image signal processing circuit for converting an input image signal to sub field data indicating ON/OFF of each sub field;

a control circuit for controlling said address control period of those sub fields whose bit data is to be aligned, thereby controlling display resolution information of an image to be displayed on said display section; and a drive circuit for addressing and turning on said pixels of said display section based on outputs of said image signal processing circuit and said control circuit, wherein said intermediate gradation processing circuit and said smoothing circuit convert data of a low order sub field, exclusive of a least significant sub field, in a manner to produce a specific sub field having identical data by processing a signal of plural lines and both of said circuits include a control-bit smoothing and error diffusion circuit which control said least significant sub field in dot-by-dot and forbid a carry to spread to a high order sub field.

9. The display according to claim 8, wherein a combination of said plurality of lines varies field by field or frame by frame.

10. The display according to claim 8, wherein a combination of said plurality of lines differs sub field by sub field in one field.

11. The display according to claim 8, wherein a quantity of those sub fields for which said address control period is controlled is controllable from outside said display.

12. The display according to claim 8, wherein signal processing for said plurality of lines in said smoothing circuit is signal processing to separate sub field data into a plurality of vertical frequency components and combine said vertical frequency components after a selection process.

13. The display according to claim 8, wherein said intermediate gradation processing circuit separates an input signal to said intermediate gradation processing circuit to a display effective gradation and a non-display low gradation, accumulates said non-display low gradation, and updating said non-display low gradation by increasing said display effective gradation when said accumulated non-display low gradation reaches said display effective gradation.

14. An image displaying method of displaying an image by turning on pixels of a display section, comprising:

an intermediate gradation processing step of controlling a minimum gradation level of said display section to thereby ensure pseudo-expression of an intermediate gradation;

a resolution limiting step of limiting display resolution information of a selected gradation level excluding said minimum gradation level, thereby shortening a time of selecting a pixel of said gradation level to be turned on; and a drive step of driving said pixels of said display section based on outputs acquired in said intermediate gradation processing step and said resolution limiting step, wherein said intermediate gradation processing step and said resolution limiting step convert data of a low order sub field, exclusive of a least significant sub field, in a manner to produce a specific sub field having identical data by processing a signal of plural lines and both of said circuits include a control-bit smoothing and error diffusion circuit which control said least significant sub field in dot-by-dot and forbid a carry to spread to a high order sub field.

15. An image displaying method of displaying an image by turning on pixels of a display section, comprising:

an intermediate gradation processing step of controlling a minimum gradation level of said display section to thereby ensure pseudo-expression of an intermediate gradation;

a resolution limiting step of limiting display resolution information of a selected gradation level excluding said minimum gradation level, thereby shortening a time of selecting a pixel of said gradation level to be turned on;

a control step of controlling said intermediate gradation processing step and said resolution limiting step to control display resolution information of an image to be displayed on said display section; and a drive step of driving said display section based on outputs acquired in said intermediate gradation processing step, said resolution limiting step and said control step, wherein said intermediate gradation processing step and said resolution limiting step convert data of a low order sub field, exclusive of a least significant sub field, in a manner to produce a specific sub field having identical data by processing a signal of plural lines and both of said circuits include a control-bit smoothing and error diffusion circuit which control said least significant sub field in dot-by-dot and forbid a carry bit to spread to a high order sub field.

16. An image displaying method of a sub field type for displaying an image by turning on addressed pixels of a display section, comprising:

an intermediate gradation processing step of ensuring pseudo-expression of an intermediate gradation by controlling a least significant sub field of said display section;

a display resolution limiting step of limiting display resolution information of at least one lower sub field excluding said least significant sub field having a minimum emission weight, thereby shortening an address control period over which a pixel of said gradation level to be turned on is selected;

a control step of controlling said intermediate gradation processing step and said resolution limiting step to control display resolution information of an image to be displayed on said display section; and a drive step of addressing and turning on said pixels of said display section based on outputs acquired in said intermediate gradation processing step, said resolution limiting step and said control step, wherein said intermediate gradation processing step and said resolution limiting step convert data of a low order sub field, exclusive of a least significant sub field, in a manner to produce a specific sub field having identical data by processing a signal of plural lines and both of said circuits include a control-bit smoothing and error diffusion circuit which control said least significant sub field in dot-by-dot and prevent a carry bit to spread to a high order sub field.

17. An image displaying method of a sub field type for displaying an image by addressing and turning on pixels of a display section arranged in a plurality of lines, comprising:

an intermediate gradation processing step of ensuring pseudo-expression of an intermediate gradation by controlling a least significant sub field;

a smoothing step of aligning bit data of sub field data of predetermined sub fields of a plurality of lines of said display section, excluding said least significant sub field, thereby limiting an address control period in said predetermined sub fields;

an image signal processing step of converting an input image signal to sub field data indicating ON/OFF of each sub field;

a control step of controlling said address control period of that sub field whose bit data is to be aligned, thereby controlling display resolution information of an image to be displayed on said display section; and a drive step of addressing and turning on said pixels of said display section based on outputs acquired in said image signal processing step and said control step, wherein said intermediate gradation processing step and said smoothing step convert data of a low order sub field, exclusive of a least significant sub field, in a manner to produce a specific sub field having identical data by processing a signal of plural lines and both of said circuits include a control-bit smoothing and error diffusion circuit which control said least significant sub field in dot-by-dot and prevent a carry to spread to a high order sub field.

18. The image displaying method according to claim 17, wherein a combination of said plurality of lines varies field by field or frame by frame.

19. The image displaying method according to claim 17, wherein a combination of said plurality of lines differs sub field by sub field in one field.

20. The image displaying method according to claim 17, wherein in said smoothing step, signal processing of said plurality of lines is executed in such a way that bit data is separated into a plurality of vertical frequency components, which are in turn selectively combined.

* * * * *